United States Patent [19]

McCafferty

[11] 4,211,019

[45] Jul. 8, 1980

[54] ACCOMMODATIVE FOOT BED

[75] Inventor: Donald F. McCafferty, Denver, Colo.

[73] Assignee: Orthopedic Contour Systems, Inc., Denver, Colo.

[21] Appl. No.: 958,549

[22] Filed: Nov. 8, 1978

[51] Int. Cl.[2] ..... A43B 13/38; B65D 25/08

[52] U.S. Cl. ..... 36/43; 128/595; 206/219

[58] Field of Search ..... 36/43, 44, 71; 128/594, 128/595; 206/219; 264/223, 244

[56] References Cited

U.S. PATENT DOCUMENTS

| | | | |
|---|---|---|---|
| 2,123,730 | 7/1938 | Huttleston | 36/71 |
| 3,121,430 | 2/1964 | O'Reilly | 128/595 |
| 3,809,224 | 5/1974 | Greenwood | 206/219 |
| 3,929,140 | 12/1975 | Wesberg | 128/595 |
| 3,985,853 | 10/1976 | Weisberg | 264/223 |
| 4,128,951 | 12/1978 | Tansill | 36/44 |

FOREIGN PATENT DOCUMENTS

| | | | |
|---|---|---|---|
| 757405 | 4/1971 | Belgium | 206/219 |
| 697723 | 9/1953 | United Kingdom | 206/219 |
| 1307459 | 2/1973 | United Kingdom | 206/219 |

*Primary Examiner*—James Kee Chi

*Attorney, Agent, or Firm*—Trask & Britt

[57] ABSTRACT

A flexible bladder, shaped as an innersole, is filled with uncured resin. An individual's foot is held atop the bladder under load while the resin is allowed to cure, thereby forming a custom-fit accommodative foot bed.

12 Claims, 9 Drawing Figures

ACCOMMODATIVE FOOT BED

BACKGROUND OF THE INVENTION

1. Field

This invention relates to orthotics, and specifically to accommodative foot beds.

2. State of the Art

Foot problems are ubiquitous among mankind. Many efforts have been made to reduce the discomfort associated with footwear by means of special insoles, arch supports and other structural inserts. To the extent that these devices have been readily available to the public, they have been intended for general use; that is, they have been intended to offer relief from the minor discomforts experienced by large segments of the public, including individuals with structurally normal feet. To alleviate specific complaints arising from individual structural deformations of the feet has traditionally required expert diagnosis by foot specialists, followed by the custom manufacture or fitting of costly orthotic devices.

Recently, innersoles containing fluid or flowable foot beds have been offered for sale. Such devices may bring relief from certain complaints, but they are not truly accommodative. Persons with skeletal defects or other anatomical maladies require a foot bed permanently formed into a custom shape adapted to their specific anatomy.

There has not heretofore been available a satisfactory accommodative foot bed of modest cost susceptible of quick, reliable custom fitting. There remains a need for such a device which can be custom fit to individuals having widely varying complaints, including those associated with skeletal defects, in a retail, as opposed to a clinical, setting.

SUMMARY OF THE INVENTION

The present invention provides an accommodative foot bed including a flexible bladder configurated as a removable innersole with an injection port to receive filling material. A resin source is adapted to deliver filling material to the bladder through the injection port. The filling material is an uncured plastic resin reaction mass which cures into a polymer having a durometer rating within the orthotic range. The reaction mass is produced by mixing the components of the resin system, preferably within the resin source itself. An ideal source is a resin pack which stores the components separately until it is desired to mix them just prior to injection into the bladder.

The bladder is filled with uncured filling material, and is then placed on a bearing surface, which may be within a shoe, but is usually a flat surface outside the shoe. A foot is placed under load on top of the bladder, causing the filling material to be redistributed. The filling material is allowed to cure, thereby producing a resilient core shaped to approximately the contour of the sole of the foot. Shims and spacers may be inserted between the sole of the foot and the bladder while the resin cures to modify the core contour if desired. The foot bed may also be machined (e.g., sanded, filed or ground) to provide additional relief.

BRIEF DESCRIPTION OF THE DRAWINGS

In the drawings, which illustrate that which is presently regarded as the best mode for carrying out the invention.

DESCRIPTION OF THE ILLUSTRATED EMBODIMENT

Figure 1:
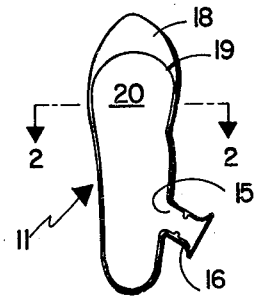
FIG. 1 is a plan view of an innersole bladder of this invention.
Figure 2:
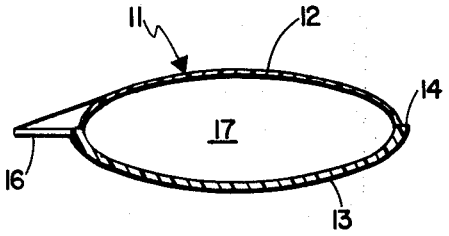
FIG. 2 is a view in cross-section taken along the line 2—2 of FIG. 1, looking in the direction of the arrows.

As illustrated, a flexible bladder, designated generally 11, is configurated as an innersole. As best shown by FIG. 2, the bladder 11 is constructed of a first layer 12 of flexible sheet material sealed to a second layer 13 of flexible sheet material about their mutual perimeters 14, expect for the region of an injection port 15. Although a variety of flexible sheet materials is operable, ranging from leather through plastic films, the presently preferred material is flexible vinyl plastic. As shown, one layer 13 is somewhat thicker because it includes an aesthetic surface, e.g., imitation leather. The use of such material is a refinement, but is not essential. An injection conduit 16 extends from attachment to (usually integral with) the layers 12, 13 and is in open communication with a cavity 17 defined between the layers 12, 13 through the port 15. A portion of the toe region 18 of the bladder 11 is shown sealed along a line 19 located just forward of the metatarsal head region 20 of the bladder 11. It is usually desirable to isolate the toe region 18 in this fashion, as will become apparent subsequently in this disclosure. Sealing of the layers 12, 13 may be by gluing, stitching, heat sealing or dielectric techniques, depending on the material of the layers 12, 13.

Figure 3:
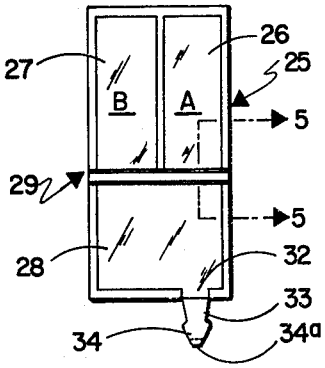
FIG. 3 is a plan view of a resin pack for storing, preparing and injecting filling material into the bladder of FIG. 1.

FIG. 3 illustrates a resin pack, designated generally 25, which constitutes a preferred source of filling material for the bladder 11. The resin pack 25 is formed from a flexible plastic bag, and includes a pair of storage chambers 26, 27 for containing the respective parts (usually designated A and B) of a two-component plastic resin system. The term "plastic resin system" refers to material, which when mixed and allowed to cure, forms a resinous polymer with a molecular weight above the 37 wax" range; typically above about 20,000. Low molecular weight, polycrystalline polymers (waxes) deform plastically under low shearing forces; that is, they "flow." They are thus not useful for the orthotic applications of this invention. Cured plastic resins of relatively higher molecular weight have good mechanical integrity and are characterized by substantially no flow and high compression set properties. While silica-based RTV elastomers, and systems of similar characteristics are useful in some instances, the systems of choice for most orthotic applications will be rigid or semi-rigid foams of polyurethane (or in some instances, polystyrene). Closed cell foams are generally more satisfactory than are open cell foams. In any event, the filling material should cure to a formed core within the cavity 17 having a hardness within the orthotic range. The term "orthotic range" means the range useful for providing proper support and comfort for the practice of orthotics. This range is necessarily variable, extending from just above the "waxy" range to extreme rigidity. For purposes of this invention, hardness may be expressed in terms of durometer measurements, the "Shore A" scale being conventional. On this basis, a Shore A durometer range of about 20 to about 50, usually above about 30 may be considered the ordinary practical operating range for the practice of this invention. For certain applications, there is no upper limit to the durometer rating acceptable for the cured filling material, provided it is custom formable in its uncured state.

Figure 4:
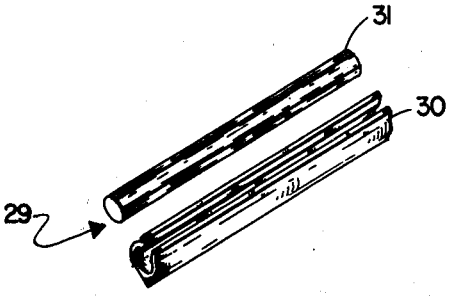
FIG. 4 is an exploded pictorial view of a removable portion of the resin pack of FIG. 3.
Figure 5:
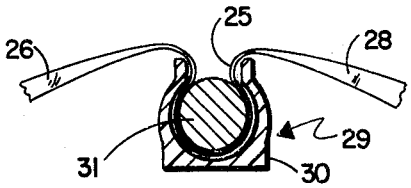
FIG. 5 is a view in cross-section taken along the line 5—5 of FIG. 3, looking in the direction of the arrows.

The storage compartments 26 and 27 are shown isolated from a mixing chamber 28 by means of a removable barrier designated generally 29. As best seen from FIGS. 4 and 5, the barrier includes a spline (or clip) portion 30 and a rod 31 portion. A fold of the plastic bag (resin pack 25) between the chamber 28 and the chambers 26, 27 is wedged into the spline 30, and is held in place by the rod 31. Other removable barriers, such as a film or foil membrane susceptible to rupture, are within contemplation, but a removable positive mechanical barrier of the type shown is presently preferred. A similar device may be used to seal an exit port 32 at the opposite side of the mixing compartment 28, but it is usually more convenient to provide a discharge conduit 33 with a plugged nozzle 34 at this location as illustrated.

By way of illustration, a procedure for custom-fitting a foot bed to an individual in accordance with this invention commences with removing the barier 29. The components A and B are transferred from the chambers 26 and 27, respectively, into the mixing chamber 28. This transfer may be effected by stripping the chambers 26, 27 with the fingers, or by squeezing the chambers to decrease their volumes. In any event, the components are mixed, e.g., by kneading action, within the mixing chamber 28 to produce an uncured reaction mass ready for injection into the cavity 17. A useful technique is to provide one component in a yellow color and the other component in a blue color. Adequate mixing is then indicated when the blended reaction mass achieves a uniform green color.

Figure 6:
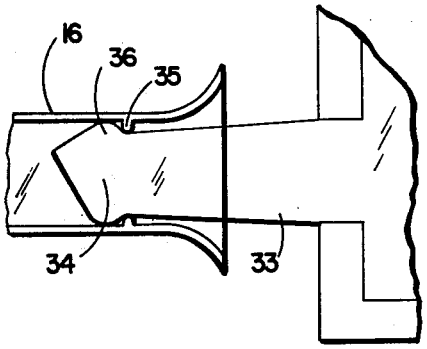
FIG. 6 is a fragmentary plan view showing a resin pack of this invention coupled to an innersole bladder of this invention.
Figure 7:
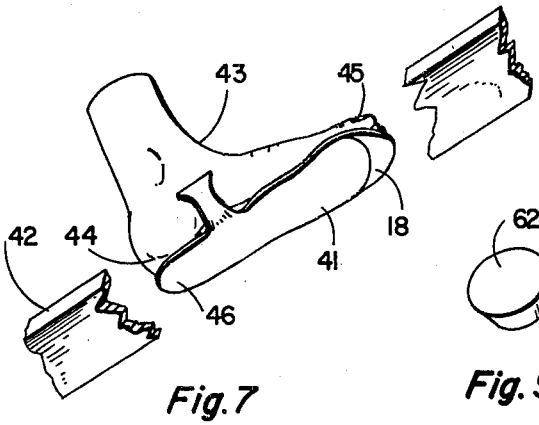
FIG. 7 is a fragmentary pictorial view showing the placement of a foot atop an innersole bladder in the practice of this invention.
Figure 8:
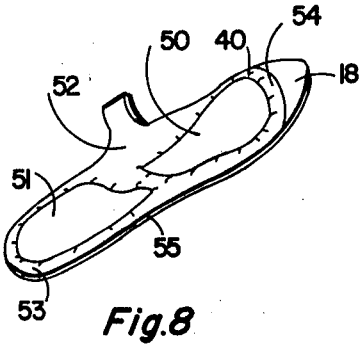
FIG. 8 is a pictorial view of a completed foot bed of this invention.

The tip 34*a* of the nozzle 34 is removed, and the nozzle 34 is inserted into the conduit 16, as best shown by FIG. 6. Various coupling arrangements are within contemplation, but as shown, a restricted neck portion 35 of the conduit 16 clasps an enlarged nozzle portion 36 of the discharge conduit 33 to effect a plug connection which resists withdrawal of the conduit 33. The contents of the mixing chamber 28 are exhausted (e.g., by squeezing the walls of the chamber 28) through the discharge conduit 33 and the injection conduit 16 into the cavity 17. It is usually desirable, although not strictly necessary, to work any entrapped air from the bladder 11 back through the conduit 16. There results a contained core of uncured filling material within the cavity 17 of the flexible bladder 11 defined by a top wall 40 and a bottom wall 41. FIGS. 7 and 8 illustrate the manner in which this core is custom shaped to the anatomy of the sole of an individual foot.

Referring to FIG. 7, the bottom wall 41 of the filled bladder 11 is placed atop a flat bearing surface 42 (shown broken away). This surface may be a bench or floor, for example. An individual's foot 43 is placed atop the top wall 40 of the bladder 11 in its normal position of use; that is, with the heel 44 and toe 45 portions of the foot 43 directly against the corresponding heel 46 and toe 18 regions of the bladder 11. Proper placement may readily be determined visually. The filling material within the cavity 17 is redistributed under load. Sufficient load is usually provided by the weight of the individual standing with his foot atop the bladder 11. In some instances, sufficient load is provided by the individual's lower leg while the individual is seated with his foot atop the bladder 11. Excess filling material is exhausted through the conduit 16, usually back through the conduit 33 and into the chamber 28 of the resin pack 25.

FIG. 8 shows the custom-fit foot bed resulting from the aforedescribed procedure. All or most of the filling material is displaced from certain regions 50, 51, adjacent the normal bearing surface of the foot 43, leaving in place solidified plastic resin support structures. These supports include a medial arch support 52, a heel stabilizer 53 and a metatarsal head support 54. As indicated, the toe region 18 is usually isolated from the cavity 17 by the forward boundary of the metatarsal head support 54, leaving room for movement of the toes.

The supports 52, 53, 54 serve to redistribute the weight of a standing, walking or running individual by increasing the contact surface between the bottom of the foot 43 and a shoe. The completed foot bed is trimmed as required to fit within a shoe. Usually it is sufficient to cut off the conduit 16 and a portion of the toe 18. If necessary, additional trimming of the heel or sides of the bladder 11 may be done by cutting or grinding. Ordinarily, however, it is permissible for the perimeter 55 of the bladder 11 behind the toe region 11 to bend to the interior contour of a shoe without trimming.

Figure 9:
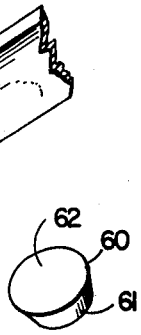
FIG. 9 is a pictorial view of a typical shim used in certain custom-fitting procedures of this invention.

In some instances, it is desired to provide pressure relief to a specific region of the foot, e.g., a metatarsal head. A detent may be ground on the finished foot bed for this purpose. Alternatively, a pressure relief detent may be molded directly into the foot bed by placement of shims between the top wall 40 of the bladder 11 and the foot 43 during the custom-fitting procedure. FIG. 9 shows an ideal shim device 60 which is structured of a pad material 61 with an adhesive surface 62. The pad material may be essentially non-compressable, but normally will be a resilient, sponge-like material with compression properties similar to those of the foot. The shim 60 may be cut to the desired shape and dimensions, and then adhered directly to the foot. The finished custom-fit foot bed will then present a depression in its upper surface in exactly the desired location to relieve the selected region of the foot in use.

For aesthetic reasons, one or both of the layers 12, 13 may be of suede, simulated leather, or other pleasing surface. It is usually preferred that at least one of these layers be transparent, however, to facilitate the removal of entrapped air prior to curing of the filling material.

Reference herein to details of the illustrated embodiments is not intended to restrict the scope of the claims, which themselves recite those details regarded as essential to the invention.

I claim

1. An accommodative foot bed system, comprising:

a flexible bladder configurated as an innersole with an injection port on one edge;

a resin pack including:

a pair of storage chambers for containing respective components of a two component plastic resin system;

a flexible mixing chamber associated with said storage chambers constituting means for receiving the components from said storage chambers for mixing to produce an uncured filling material;

removable barrier means arranged to isolate said components from each other when in place and to permit passage of said components into said mixing chamber when removed;

discharge means associated with said mixing chamber for ejecting said filling material from said mixing chamber; and sealing means associated with said discharge means; and means cooperatively adapted between said injection port and said discharge means to effect a connection between said discharge means and said injection port so that said filling material may be injected into the interior of said bladder from said mixing chamber when said sealing means is removed.

2. An accommodative foot bed system according to claim 1 wherein said bladder includes a first layer of flexible sheet material and a second layer of flexible sheet material congruent with and overlapping said first layer, both said layers being configurated as an innersole with an extension from the instep portion thereof, sealed together around their perimeters to constitute said bladder, including a cavity defined by said layers, with a flexible tube extending from open communication with said cavity through said injection port.

3. An accommodative foot bed system according to claim 2 wherein said flexible tube has a restricted neck portion and said discharge means has an enlarged nozzle portion adapted to effect a plug connection with said tube, whereby said nozzle is locked in place by said neck.

4. An accommodative foot bed system according to claim 3 wherein said flexible tube has a restricted neck portion and said discharge means has an enlarged nozzle portion adapted to effect a plug connection with said tube, whereby said nozzle is locked in place by said neck.

5. An accommodative foot bed system according to claim 2 wherein the cavity between said layers is configurated to prevent flow of resin in the region of the bladder corresponding with the toe area of a foot placed atop said bladder in the normal position of use, but to permit flow of resin in the region of the bladder corresponding with the medial arch, heel perimeter and metatarsal head areas of said foot.

6. An accommodative foot bed system according to claim 5 wherein said filling material is curable into a polyurethane having a durometer rating within the orthotic range.

7. An accommodative foot bed system according to claim 6 wherein said polyurethane is curable to a Shore A durometer rating of between about 20 to about 50.

8. An accommodative foot bed system comprising a flexible bladder constructed of a first layer of flexible transparent sheet material and a second layer of flexible sheet material congruent with and overlapping said first layer, both said layers being configurated as an innersole with an extension from the instep portions thereof, sealed together around their perimeters to constitute said bladder, including a cavity defined by said layers with a flexible tube extending from open communication with said cavity;

a resin pack including:

a pair of storage chambers for containing respective components of a two component plastic resin system;

a flexible mixing chamber associated with said storage chambers constituting means for receiving the components from said storage chambers for mixing to produce an uncured filling material;

removable barrier means arranged to isolate said components from each other when in place and to permit passage of said components into said mixing chamber when removed;

discharge means associated with said mixing chamber for ejecting said filling material from said mixing chamber; and sealing means associated with said discharge means; and means cooperatively adapted between said flexible tube and said discharge means to effect a connection between said discharge means and said flexible tube so that said filling material may be injected into the interior of said bladder from said mixing chamber when said sealing means is removed.

9. An accommodative foot bed system according to claim 8 wherein the outside surface of said second layer is provided with a suede surface texture.

10. An accommodative foot bed system according to claim 8 wherein the components contained within the respective said storage chambers are individually colored so that when they are mixed in said mixing chamber, the resulting uncurred filling material assumes a characteristic third color.

11. An accommodative foot bed system according to claim 10 wherein one of said components is colored yellow and the other of said components is colored blue so that adequate mixing is indicated when the reaction mass achieves a uniform green color.

12. An accommodative foot bed system according to claim 8 wherein said filling material is curable into a polyurethane foam having a Shore D durometer rating of between about 20 to about 50.

* * * * *